US007809304B2

(12) United States Patent
Hatano et al.

(10) Patent No.: US 7,809,304 B2
(45) Date of Patent: Oct. 5, 2010

(54) DUCT FOR IMAGE FORMING APPARATUS

(75) Inventors: Fukashi Hatano, Toride (JP); Kiyoshi Oyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 361 days.

(21) Appl. No.: 12/036,589

(22) Filed: Feb. 25, 2008

(65) Prior Publication Data

US 2008/0205925 A1 Aug. 28, 2008

(30) Foreign Application Priority Data

Feb. 26, 2007 (JP) ..... 2007-046088

(51) Int. Cl.
*G03G 15/00* (2006.01)
*G03G 21/00* (2006.01)
*G03G 21/20* (2006.01)

(52) U.S. Cl. ..... 399/92; 399/98; 399/99

(58) Field of Classification Search ..... 399/91, 399/92, 93, 94, 97, 98, 99, 107
See application file for complete search history.

(56) References Cited

U.S. PATENT DOCUMENTS

| | | | | |
|---|---|---|---|---|
| 4,693,588 | A * | 9/1987 | Yarbrough et al. | 399/93 |
| 7,403,741 | B2 * | 7/2008 | Yoshihara et al. | 399/411 |
| 7,415,219 | B2 * | 8/2008 | Kawamata | 399/92 |
| 7,447,462 | B2 * | 11/2008 | Nishimura et al. | 399/92 |
| 2002/0186986 | A1 * | 12/2002 | Makihira | 399/92 |
| 2006/0216055 | A1 * | 9/2006 | Katoh et al. | 399/93 |
| 2007/0019981 | A1 * | 1/2007 | Kawamata | 399/92 |
| 2008/0030808 | A1 | 2/2008 | Oyama et al. | 358/498 |
| 2008/0030809 | A1 | 2/2008 | Itabashi et al. | 358/498 |

FOREIGN PATENT DOCUMENTS

| | | |
|---|---|---|
| JP | 2005-140971 | 6/2005 |
| JP | 2005-215232 | 8/2005 |
| JP | 2006163135 A * | 6/2006 |

* cited by examiner

*Primary Examiner*—David M Gray
*Assistant Examiner*—Fred Braun
(74) *Attorney, Agent, or Firm*—Fitzpatrick, Cella, Harper & Scinto

(57) ABSTRACT

A duct for an image forming apparatus for forming an image on a recording material, the duct includes a discharge opening for discharging air; a fan, mounted to a neighborhood of the discharge opening, for discharging the air; first and second openings for suction of air; a first guiding portion, having first and second openings, for guiding the sucked air; a separation member, provided in the first guiding portion, for separating a flow of the air sucked by the first opening and a flow of the air sucked by the second opening; a second guiding member, disposed overlapped with the first guiding portion, for guiding the air guided by the first guiding portion; a first interconnection opening for feeding the air from the first opening to the second guiding portion; a second interconnection opening for feeding the air from the second opening to the second guiding portion, wherein the first interconnection opening is disposed closer to the discharge opening than the second interconnection opening, and wherein the first interconnection opening has a size smaller than the second interconnection opening.

10 Claims, 8 Drawing Sheets

(a) 1st DUCT (b) 2nd DUCT (a)

(b)

DUCT FOR IMAGE FORMING APPARATUS

FIELD OF THE INVENTION AND RELATED ART

The present invention relates to a duct mounted in an image forming apparatus, such as a printer, a facsimile machine, a multifunction image forming apparatus and so on.

An image forming apparatus, that is, an apparatus for forming an image on recording medium, is made up of a photosensitive drum (photosensitive drums), a developing apparatus (developing apparatuses), a charging apparatus (charging apparatuses), a fixing apparatus, etc. Some image forming apparatuses are provided with an air exhausting apparatus, which has an air duct (which hereafter may be referred to simply as duct). The duct is disposed close to one of the abovementioned components. For example, in order to prevent the toner which scattered from the development sleeve, which rotates at a high speed, from adhering to the photosensitive drum(s), an air exhausting apparatus having a duct is placed in the adjacencies of the photosensitive drum and/or developing apparatus (Japanese Laid-open Patent Applications 2005-215232). There is also an image forming apparatus in which an air exhausting apparatus having a duct is disposed next to its corona discharging apparatus, in order to prevent the photosensitive drum(s) and the mechanism therefor, from being affected by the by products of coronal discharge. Further, there is an image forming apparatus in which an exhausting apparatus having a duct is disposed next to its fixing apparatus, in order to prevent the adjacencies of the fixing apparatus from overheating.

Japanese Laid open Patent Application 2005-140971 discloses an air exhausting apparatus for an image forming apparatus. This air exhausting apparatus is made up of an air duct and an air drawing fan. The duct is disposed directly below where the distance between the development sleeve and photosensitive drum is smallest, and the fan is located at the rear end of the duct (part of air passage). The air duct shown in FIG. 8 is provided with multiple air intake openings, which are aligned in the front-to-rear direction (relative to where fan is present), that is, the direction parallel to the axial line of the photosensitive drum. The duct is in the form of a parallelepiped. Its top wall has three air intake openings, which are arranged with equal intervals. The exhausting apparatus is provided with an unshown forced air flow generating apparatus, which is in connect with one of the lengthwise ends of the duct 10. The forced air flow generating apparatus generates an air flow in such a direction that air flows out of the common air outlet opening 144 which leads to the forced air flow generating apparatus, in the direction indicated by arrow marks in FIGS. 8(*a*) and 8(*b*). The air drawing duct 327 is provided with partitioning walls 121 and 122, which are positioned to provide three air passages 131, 132, and 133 which extend from the air intake openings 111, 112, and 113 to the common air outlet opening 144 (forced air flow generating apparatus) without intersecting with each other. Arranging the air passages and air intake openings 111, 112, and 113 as described above equalizes the multiple air intake openings in the amount by which air is taken into the duct 327 through them.

However, the above described duct structure suffers from the following problem. That is, it makes an air intake closer to the common openings 114 higher in air speed, making the multiple air intake openings different in the amount by which air is taken into the duct 327 through them. Further, air is drawn into the duct 327 through the air intake openings 111, 112, and 113 in the direction indicated by the arrow marks in FIG. 8(*b*). That is, the air flows which generate as air is drawn into the duct 327 are inclined relative to the direction perpendicular to the lengthwise direction of the duct 327 (direction parallel to axial line of photosensitive drum); the downstream ends of the air flows are closer to the common air outlet opening 144. In addition, the farther from the common opening 144 the air intake opening, the smaller the intake opening in the amount of force by which air is drawing into the duct 327 through it. Thus, in terms of the amount by which air is drawing into the duct 327, the duct 327 is not uniform across the entirety of its lengthwise range; its air intake openings are different in the amount of force by which air is drawn into the duct 327. Therefore, in order to minimize the effect of the above-described phenomenon, it is necessary to provide a substantial amount of distance between each air intake opening and the common air outlet opening, making it necessary to increase the duct in size.

SUMMARY OF THE INVENTION

Thus, the primary object of the present invention is to provide an air duct for an air exhausting apparatus, which is no larger in size than a conventional air duct for an air exhausting apparatus, and yet, is uniform in the amount of force by which air is drawing into the duct, across its entire range in its lengthwise direction.

According to an aspect of the present invention, there is provided a duct for an image forming apparatus for forming an image on a recording material, said duct comprising a discharge opening for discharging air; a fan, mounted to a neighborhood of said discharge opening, for discharging the air; first and second openings for suction of air; a first guiding portion, having first and second openings, for guiding the sucked air; a separation member, provided in said first guiding portion, for separating a flow of the air sucked by said first opening and a flow of the air sucked by said second opening; a second guiding member, disposed overlapped with said first guiding portion, for guiding the air guided by said first guiding portion; a first interconnection opening for feeding the air from said first opening to said second guiding portion; a second interconnection opening for feeding the air from said second opening to said second guiding portion, wherein said first interconnection opening is disposed closer to said discharge opening than said second interconnection opening, and wherein said first interconnection opening has a size smaller than said second interconnection opening.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in the first embodiment of the present invention will be described in detail with reference to the appended drawings. However, the application of the present invention is not limited to the air exhausting apparatuses in the following embodiments of the present invention. That is, the present invention is applicable to a part, parts, or the entirety, of any air duct which extends from one end of an apparatus in which the air duct is placed, to the other, and which has multiple air intake openings (or air outlet openings), which are arranged in the lengthwise direction of the duct, across the entire lengthwise range of the duct, to draw air into the duct (or to blow air out of duct), and a common air passage through which air is drawn out of (or into) the apparatus.

This embodiment will be described with reference to an image forming apparatus which employs an intermediary transfer belt, and which forms a full-color image by layering multiple toner images of the primary colors (into which an optical image of an intended image was separated), on the intermediary transfer belt. However, the present invention is also applicable to an image forming apparatus which directly layers two or more toner images, different in color, onto recording medium. It can also be embodied in the form of an air duct usable with an image forming apparatus having an intermediary transfer drum or recording medium transferring drum, instead of the intermediary transfer belt or recording medium conveying drum, respectively. In other words, the present invention is applicable to various types of air duct usable with various image forming apparatuses, which are different in usage, for example, printers, various printing machines, copying machines, multifunction image forming apparatuses, etc.

<Image Forming Apparatus>

Figure 1:
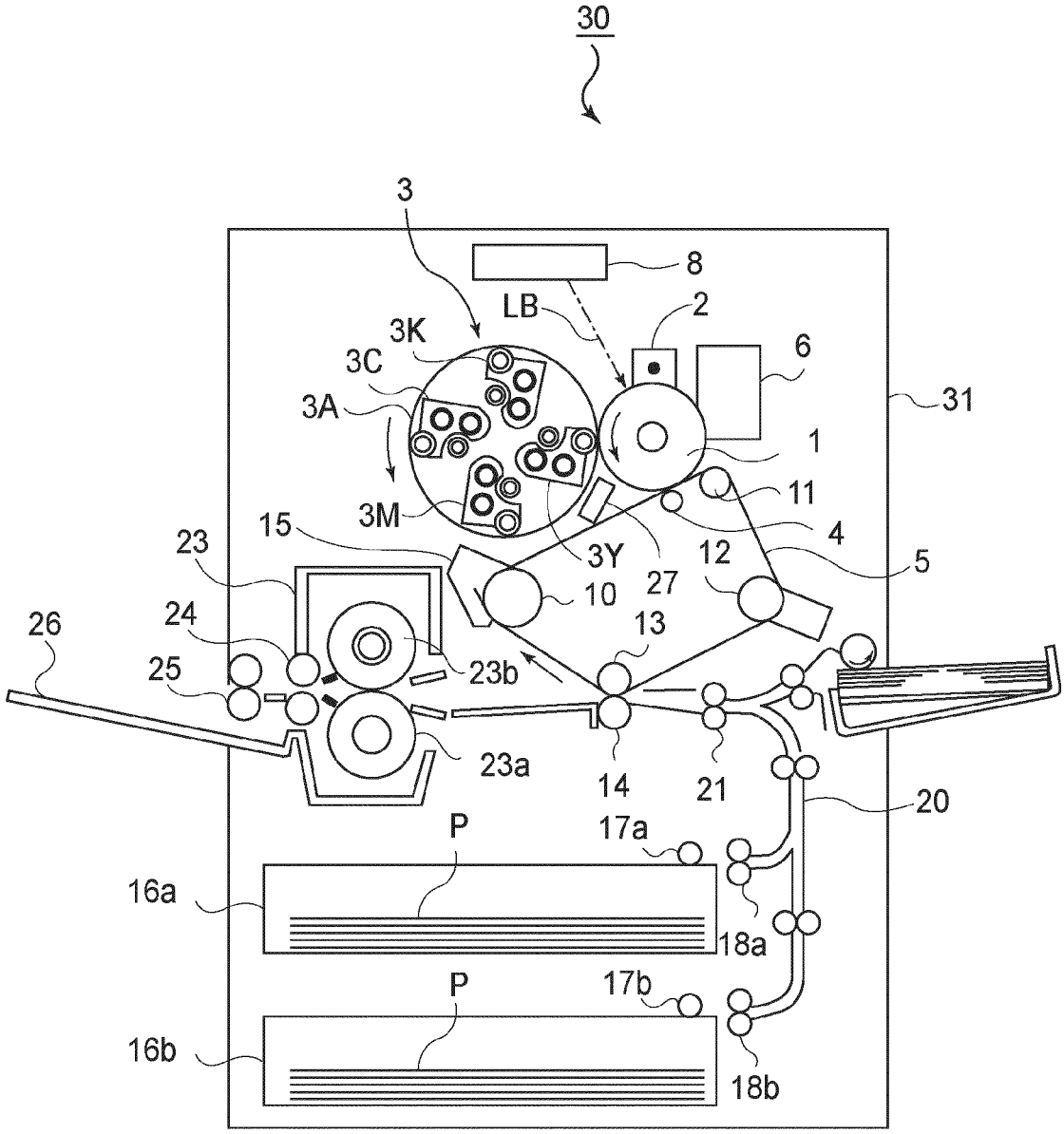
FIG. 1 is a schematic sectional view of the image forming apparatus in one of the preferred embodiments of the present invention, showing the general structure of the apparatus.

FIG. 1 is a schematic sectional view of the image forming apparatus in one of the preferred embodiments of the present invention, and shows the general structure of the apparatus. The image forming apparatus 30 shown in FIG. 1 is a full-color laser printer, that is, an electrophotographic image forming apparatus. It employs an intermediary transferring member. The image forming apparatus 30 is provided with a photosensitive drum 1, as an image bearing member, which is disposed in the main assembly of the image forming apparatus 30. It is also provided with a charging device 2, an exposing apparatus 8, a developing apparatus 3, a primary transfer roller 4, and a cleaning apparatus 6, which are arranged in the adjacencies of the peripheral surface of the photosensitive drum 1, in the listed order, in terms of the rotational direction of the photosensitive drum 1.

The charging device 2 uniformly charges the peripheral surface of the photosensitive drum 1. The exposing apparatus 8 forms an electrostatic latent image on the peripheral surface of the photosensitive drum 1 by scanning (exposing) the uniformly charged peripheral surface of the photosensitive drum 1 with the beam of laser light LB which its emits while modulating the beam of laser light LB with the pictorial signals inputted into the exposing apparatus 8. More specifically, as the beam of laser light LB is emitted from a semiconductor laser (light source) while being modulated with the pictorial signals, it is deflected by a polygon mirror, which is being rotated at a preset high speed, in a manner to oscillate, and then, is projected onto the peripheral surface of the photosensitive drum 1 by way of a focusing lens (lenses), mirrors, etc.

The developing apparatus 3 deposits toner to the electrostatic latent image formed on the peripheral surface of the photosensitive drum 1, forming thereby a toner image on the peripheral surface of the photosensitive drum 1. The developing apparatus 3 is made up of a development rotary 3A, and four development units, that is, a yellow development unit 3Y, a magenta development unit 3M, a cyan development unit 3C, and a black development unit 3K, which are held in the rotary 3A. The yellow development unit 3Y, magenta development unit 3M, cyan development unit 3C, and black development unit 3K contain yellow, magenta, cyan, and black toners, respectively. The development rotary 3A is rotatable by an unshown driving apparatus in the direction indicated by an arrow mark so that any of the development units (3Y, 3M, 3C, and 3K) held in the rotary 3A can be moved into the development position in which the development unit opposes the photosensitive drum 1.

The primary transfer roller 4 is pressed against the peripheral surface of the photosensitive drum 1, with the presence of the intermediary transfer belt 5 (intermediary transferring member) between the primary transfer roller 4 and photosensitive drum 1. It is used to transfer (primary transfer) the toner image formed on the photosensitive drum 1, onto the intermediary transfer belt 5. The intermediary transfer belt 5 is supported and kept tensioned by a driver roller 10 and three follower rollers 11, 12, and 13, and is circularly driven by the driver roller 10 in the direction indicated by an another arrow mark while remaining in contact with the peripheral surface of the photosensitive drum 1. The cleaning apparatus 6 removes and recovers the toner remaining on the photosensitive drum 1 after the transfer (primary transfer).

As an image forming operation start signal is issued, the photosensitive drum 1 is rotationally driven in the direction indicated by the arrow mark, at a preset process speed, while its peripheral surface is uniformly charged to a preset potential level (which is negative in this embodiment) by the charging apparatus 2. Then, the uniformly charged peripheral surface of the photosensitive drum 1 is scanned by the beam of laser light LB emitted by the exposing apparatus 8; it is exposed by the exposing apparatus 8. As a result, an electrostatic latent image, which corresponds to the first primary color (yellow component) of an intended full-color image, is effected on the peripheral surface of the photosensitive drum 1.

While the latent image for yellow color is being formed, the development unit 3Y of the developing apparatus 3 is moved into the development position by the rotation of the development rotary 3A. In the development position, the electrostatic latent image on the photosensitive drum 1 is reversely developed into a visible image by the application of development bias; yellow toner is adhered to the numerous exposed points of the uniformly charged portion of the peripheral surface of the photosensitive drum 1. Then, the yellow toner image formed on the photosensitive drum 1 is transferred (primary transfer) onto the intermediary transfer belt 5 by the application of the primary transfer bias to the primary transfer roller 4. After the transfer (primary transfer) of the yellow toner image onto the intermediary transfer belt 5, the toner remaining on the photosensitive drum 1, that is, the toner which was not transferred onto the photosensitive drum 1, is removed by the cleaning apparatus 6. Also after the primary transfer of the yellow toner image, the development rotary 3A is rotationally driven to sequentially move the magenta, cyan, and black development units 3M, 3C, and 3B, respectively, into the development position.

Then, the process (which includes formation of electrostatic latent image, development of latent image, primary transfer, and cleaning) similar to the one carried out to form the yellow toner image, that is, the toner image of the first primary color, is repeated three times to sequentially form the magenta (second color), cyan (third color), and black (fourth color) toner images. As the magenta, cyan, and black toner images are sequentially formed on the photosensitive drum 1, they are sequentially transferred in layers onto the intermediary transfer belt 5 so that they align with the yellow toner image on the intermediary transfer belt 5. As a result, a single full-color toner image, which matches in color to the intended full-color image, is effected on the intermediary transfer belt 5.

Meanwhile, the recording mediums P in a cassette 16*a* (16*b*) are fed into the main assembly of the image forming apparatus 30 while being separated one by one by a pickup roller 17*a* (17*b*) and a pair of separation rollers 18*a* (18*b*), and then, are conveyed to a pair of registration rollers 21 through a recording medium conveyance path 20.

The image forming apparatus 30 is also provided with a secondary transfer roller 14, which is disposed in a manner to oppose the roller 13. The secondary transfer roller 14 can be placed in contact with, or separated from, the intermediary transfer belt 5. As the secondary transfer roller 14 is pressed against the roller 13, it is pressed upon the intermediary transfer belt 5, forming thereby the second transferring portion. The recording medium P is conveyed to the second transferring portion by the registration rollers so that it arrives at the second transferring portion at the same time as the full-color image on the intermediary transfer belt 5 reaches the secondary transfer portion. In the secondary transferring portion, the four toner images, different in color, (which make up a full-color image), on the intermediary transfer belt 5 are transferred together (secondary transfer) onto the recording medium P by the secondary transfer roller 14 to which the secondary transfer bias is being applied. The secondary transfer residual toner, that is, the toner on the intermediary transfer belt 5, which was not transferred onto the recording medium P, is removed by the cleaning apparatus 15.

After the transfer of the full-color toner image onto the recording medium P, the recording medium P is conveyed to the fixing apparatus 23, which is made up of a fixation roller 23*b* and a pressure roller 23*a*. The fixation roller 23*b* has an internal heater, and forms a fixation nip between itself and the pressure roller 23*a*. Then, the recording medium P is conveyed through the fixation nip N of the fixing apparatus. While the recording medium P is conveyed through the fixation nip N while remaining pinched between the two rollers 23*b* and 23*a*, the full-color toner image is fixed to the recording medium P by being subjected to heat and pressure. Thereafter, the recording medium P is discharged into a tray 26 by way of two pairs of discharge rollers 24 and 25.

<Duct>

Figure 2:
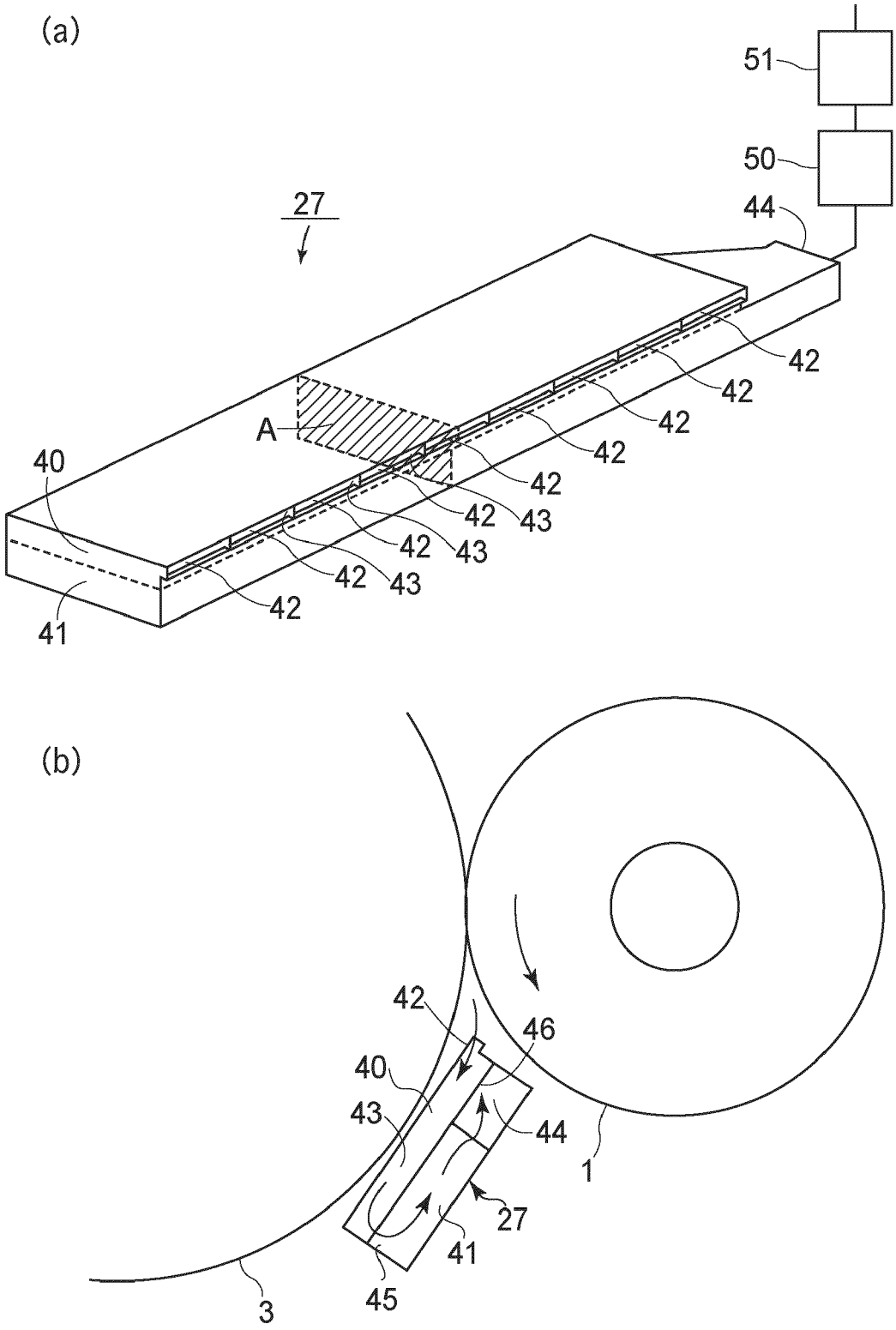
FIG. 2 is a schematic drawing which shows the external appearance of the air duct (which is an air drawing duct in this case), and the positioning of the air duct.
Figure 3:
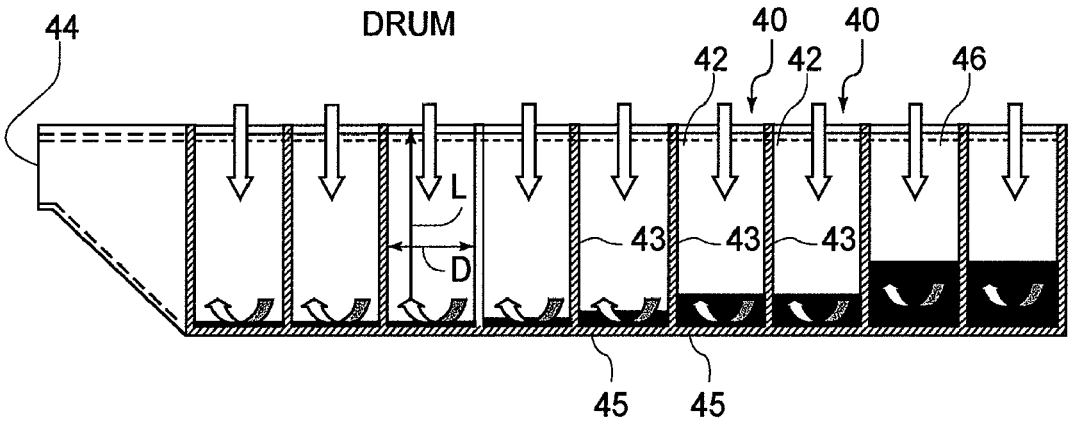
FIG. 3 is a longitudinal sectional view of the air drawing duct.
Figure 3:
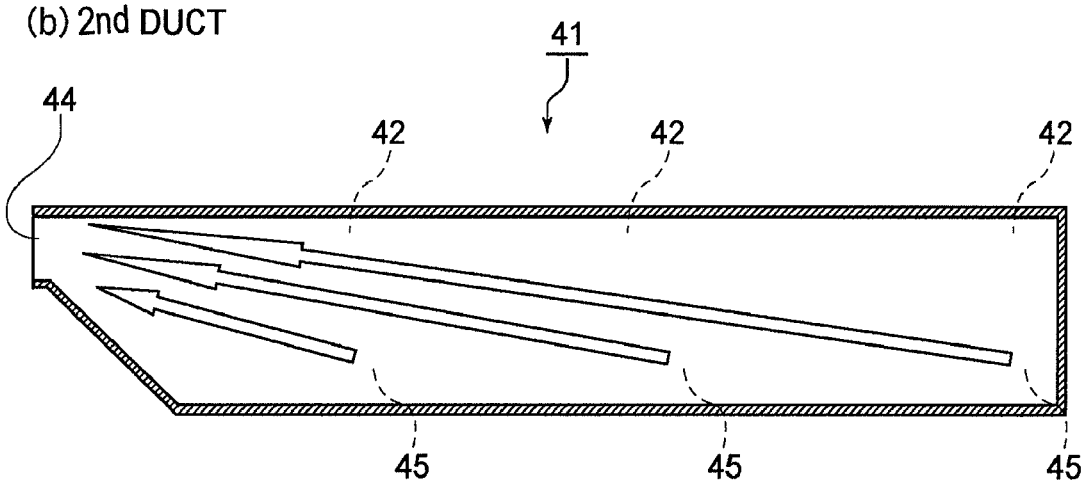
Figure 4:
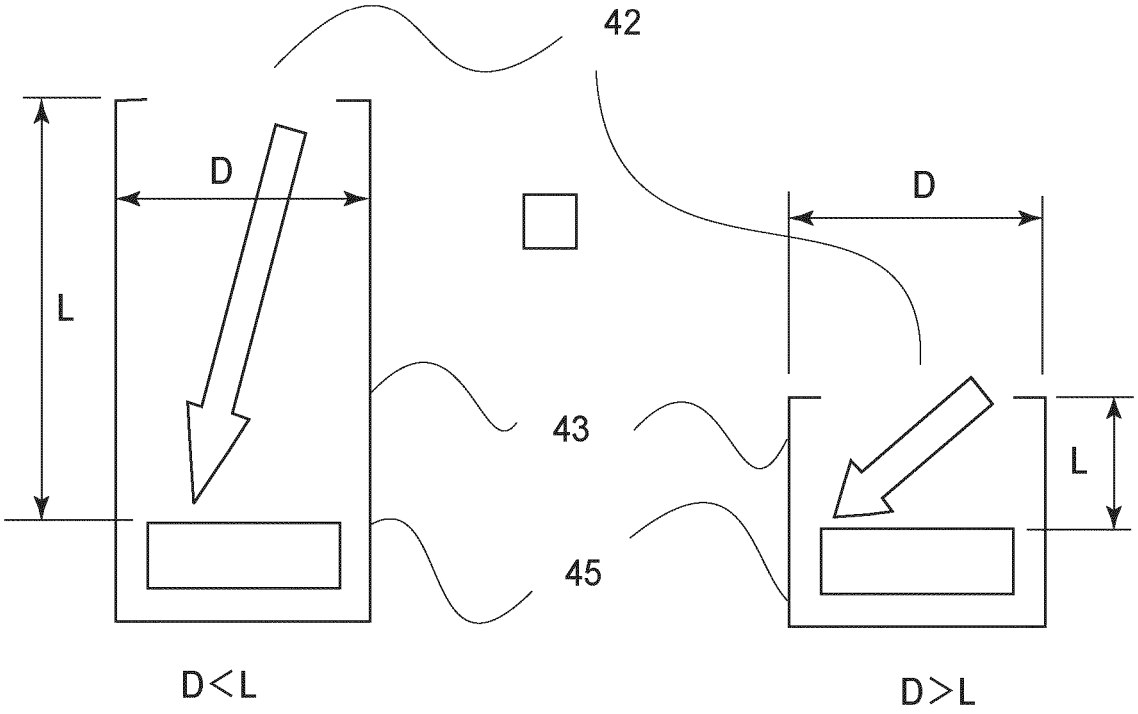
FIG. 4 is schematic drawing which shows the relationship between the distance between the upstream wall and downstream walls of each of the subsections of the second section of the air duct, and the length of the air flow in the subsection.
Figure 5:
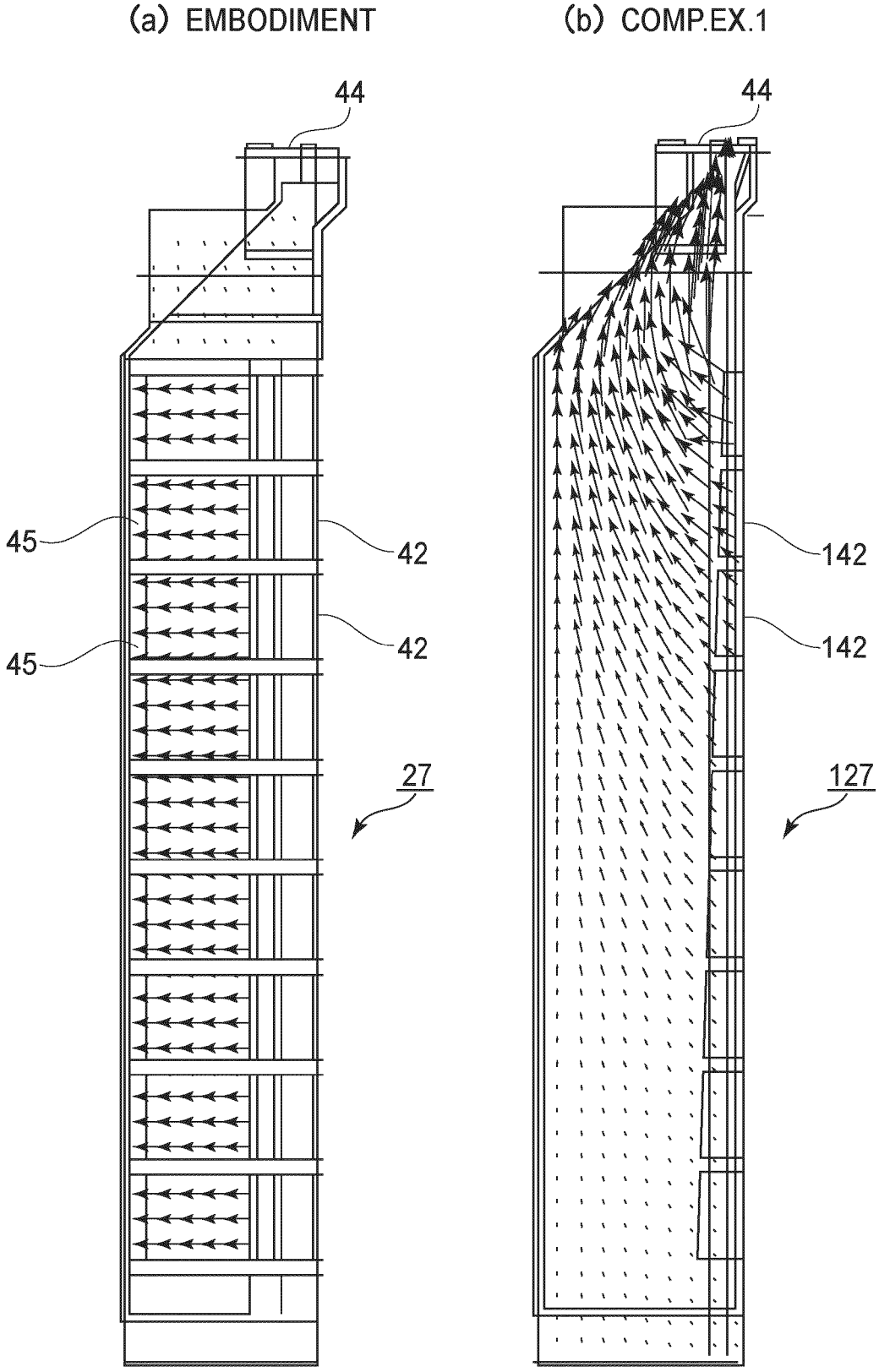
FIG. 5 is a schematic drawing which shows the direction and strength of the air flow in the air duct, which were obtained by the calculation based on the results of the simulation.

FIG. 2 is a schematic drawing which depicts the external appearance of the air suctioning duct in the first embodiment (which hereafter may be referred to simply as duct) and the positioning of the duct. FIG. 3 is a longitudinal schematic sectional view of the air suctioning duct. FIG. 4 is a schematic drawing which described the relationship between the distance between the upstream wall and downstream walls of each of the subsections of the second section of the air duct, and the length of the air flow in the subsection. FIG. 5 is a schematic drawing which shows the direction and strength of the air flow in the air duct, which were obtained by the calculated based on the results of the simulation. More specifically, FIG. 2(*a*) is an external perspective view of the entirety of the duct, and FIG. 2(*b*) is a schematic sectional view of the duct, at Plane A in FIG. 2(*a*). FIG. 3(*a*) is a longitudinal and horizontal schematic sectional view of the second section of the duct, and FIG. 3(*b*) is a longitudinal and horizontal schematic sectional view of the first section of the duct. FIGS. 5(*a*) and 5(*b*) correspond to the duct in the first embodiment and Comparative Example 1 of duct, respectively.

Referring to FIG. 1, the image forming apparatus 30 is provided with an air duct 27, which is disposed, as an air drawing duct, on the downstream side of the developing apparatus 3, in order to recover toner particles as they scatter from the developing apparatus 3. The air drawing duct 27 is roughly the same in length as the photosensitive drum 1, and is disposed in the narrow space surrounded by the photosensitive drum 1, development rotary 3A, and intermediary transfer belt 5.

Next, referring to FIG. 2, the air drawing duct 27 has an air outlet opening 44 (which hereafter will be referred to as outlet opening 44) through which air is drawn out from the duct 27 by a fan 50. The air drawing duct 27 also has a first section and a second section 41. The first and second sections 40 and 41 are the two types of air passages in the duct 27. The first section has multiple subsections 40, which hereafter will be referred to as the first ducts 40, whereas the second section 41 will be referred to as the second duct 41. Each first duct 40 has an air intake opening (which hereafter will be referred to as intake opening), and a connective opening 45 as the air passage between the first and second ducts 40 and 41. After air is taken into the first duct 40, it is sent into the second duct 41 through the connective opening 45. The second duct 41 is the second air guiding passage, in which air is flowed toward the air outlet opening 44.

The outlet opening 44 is open at one of the lengthwise ends of the duct 27; it is located at one of the lengthwise ends of the lateral wall of the duct 27, which has the intake openings 42. The intake openings 42 are the opening through which the internal air of the image forming apparatus 30 (which is example of image forming apparatus which forms image on recording medium P) is drawn into the duct 27. The multiple first ducts 40 and multiple connective openings 45 are arranged in the direction parallel to the lengthwise direction of the air drawing duct 27, making up the first air guiding section.

Referring to FIG. 3, the multiple first ducts 40 are different in the size of the connective opening 45. For example, the connective opening 45 of the first duct 40 is different in size from that of the second first duct 40.

Further, the multiple first ducts 40 are different in their distance from the outlet opening 44. For example, the distance of the first duct 40 from the outlet opening 44 is greater than the distance of the second first duct 40 from the outlet opening 44. Further, the size of the connective opening 45 of the first duct 40 is greater in the size of the connective opening 45 of the second first duct 40.

The distance between the intake opening of each of the multiple first ducts 40, and the connective opening 45, is greater than the distance between the adjacent two partitioning walls 43.

The air drawing duct 27 has a double-deck structure. That is, the first section of the duct 27 (made up of multiple first ducts 40), that is, the first air guiding section, constitutes the top tier, whereas the second duct 41, that is, the second air guiding section, constitutes the bottom tier.

The image forming apparatus 30 has the photosensitive drum 1, which is an example of image bearing member which bears a toner image. Each air intake opening 42 is located so that it opposes the peripheral surface of the photosensitive drum 1.

Referring to FIG. 2(*a*), the air drawing fan 50 is located at the rear end of the second duct 41. The multiple intake openings 42, which are for drawing air from the adjacencies of the photosensitive drum 1 into the air drawing duct 27, are arranged in a straight line parallel to the axial line of the photosensitive drum 1, along the peripheral surface of the photosensitive drum 1 which is the object to be protected from the above mentioned stray toner particles, that is, the toner particles scattered from the developing apparatus.

The air drawing duct 27 is double-decked as described above. More specifically, the second ducts 41, which extends in the lengthwise direction of the air drawing duct 27, and the nine first ducts 40, which extend in the widthwise direction the second duct 41, are arranged side by side in the lengthwise direction of the air drawing duct 27 (direction in which second duct 41 extends). The second duct 41 is the air passage through which air flows toward the outlet opening 44, whereas each first duct 40 is the connective passage, between the intake opening 42 and connective opening 44, through which air is drawn into the second duct 41.

The nine intake openings 42, which the nine first ducts 40 have one for one, are the same in size (cross section). Each first duct 40 is in connection to the second duct 41 on the opposite side from the corresponding intake opening 42. The air drawing duct 27 is provided with the air outlet opening 44, which is open at the rear end of the second duct 41. The air outlet opening 44 is fitted with the air drawing fan 50 and a toner recovery filter 51. Incidentally, the air drawing fan 50 may be attached to the air drawing duct 27, or disposed away from the air drawing duct 27.

Referring to FIG. 2(*b*), the adjacent two first ducts 40 are separated from each other by the partitioning wall 43, which is an example of partitioning plate. The second duct 41 and first ducts 40 are partitioned from each other by the floor wall (bottom wall) 46. The floor wall 46 is provided with the connective openings 45, each of which is an example of connective hole, through which each first duct 40 is in connection with the second duct 41.

As the air drawing fan 50, with which the air outlet opening 44 is fitted, is started, an air flow is generated, which flows into the air drawing duct 27 from outside the air drawing duct 27 through the intake openings 42. After advancing into the first ducts 40 through their air intake openings 42, the air flows downward through the connective opening 45, and joins (combines) with the air flow in the second duct 41 as it flows downward through the connective opening 45. Then, after the air flow from the first duct 40 joins the air flow in the second duct 41, the combination of the two bodies of air flows toward the outlet opening 44, and then, is exhausted through the outlet opening 44. Thus, the stray toner particles, more specifically, the toner particles having scattered from the developing apparatus 3, are picked up by this air flow, enter the first ducts 40 with the air flow, descend with the air flow through the connective openings 45, join the air flow in the second duct 41 at the connective opening 45. Then, they are exhausted through the outlet opening 44. The air drawing duct 27 is placed below the contact area between the developing apparatus 3 and photosensitive drum 1, and is set in such an attitude so that the connective openings 45 are positioned higher than the corresponding intake openings 42. Therefore, even after the air drawing fan 50 stopped, it does not occur that the toner particles in the air drawing duct 27 come out through the intake openings 42.

Referring to FIG. 3(*a*), in terms of the lengthwise direction of the air drawing duct 27, the dimension of each intake opening 42 is roughly the same as the interval between the adjacent two partitioning walls 43. Therefore, as the air drawing fan 50 is activated, the presence of the partitioning walls 43 allows virtually no area in the adjacencies of the peripheral surface of the photosensitive drum 1, to be free from the air flow which occurs in the area in which the intake openings 42 of the air drawing duct 27 face the peripheral surface of the photosensitive drum 1. Further, the air drawing duct 27 in the first embodiment is provided with the nine small air intake openings 42, instead of a single large air intake opening. Therefore, the difference in the amount of air flow between the lateral edge portions and center portion of each first duct 40 is smaller. Further, as air is drawn into the second duct 41 of the air drawing duct 27 through the first ducts 40, the air is made to flow in parallel to the partitioning walls 43. Therefore, the angle at which air is drawn into the air drawing duct 27 through the first ducts 40, across the entire lengthwise range of the air drawing duct 27 (entire range of photosensitive drum), is roughly 90° relative to the lengthwise direction of the lengthwise direction of the air drawing duct 27. The outlet opening 44 is open at one of the lengthwise ends of the air drawing duct 27. Therefore, if the first ducts 40 is not provided with a substantial number of partitioning walls such as the partitioning walls 43, the air flows which air generates as it is drawn into the air drawing duct 27 through the first ducts 40 are likely to deviate in such a direction that its downstream end is closer to the outlet opening 44 than its upstream end. However, with the employment of the above described structural arrangement in accordance with the present invention, the direction of the air flow entering the air drawing duct 27 is roughly 90° relative to the lengthwise direction of the duct 27. Therefore, each first duct 40 is minimized in the nonuniformity in the amount of force by which air is drawn into the first duct 40, in terms of the lengthwise direction of the duct 27. Also in terms of the lengthwise direction of the duct 27, each of the connective openings 45 with which the floor wall 46 is provided is the same in dimension as the interval between the adjacent two partitioning walls 43. Therefore, the air passage which the adjacent two partitioning walls 43 provide between the first duct 42 and connective opening 45 is uniform in cross section. Therefore, the partitioning walls 43 contribute to the straightening of air flow, across their entire length. Therefore, the air drawing duct 27 is even in the amount of force by which air is drawing into the duct 27, across its entire lengthwise range, more specifically, at least between the adjacent two intake openings 42.

Further, as described above, each of the multiple first ducts 40 separated from the next first ducts 40 by the partitioning walls 43 is provided with the connective opening 45. The multiple connective openings 45 are adjusted (made different) in size using the following method. That is, in terms of the lengthwise direction of the air drawing duct 27, the multiple connective openings 45 are the same in dimension, whereas in terms of the direction perpendicular to the lengthwise direction of the air drawing duct 27, they are different in dimension. More specifically, the connective openings 45 are adjusted (made different) in size so that the farther they are from the outlet opening 44, the greater in size they are. Therefore, the first ducts 40 are roughly the same in the amount of air flow. Thus, the air pressure loss attributable to the second duct 41 is compensated for by this arrangement. That is, of any two first ducts 40, the one which is farther from the outlet opening 44, being therefore less in the amount of the difference between its internal and external pressures, than the other, is provided with the necessary amount of air flow. Since the first ducts 40 are individually adjusted in the amount of air flow as described above to make the air drawing duct 27 uniform across its entire lengthwise range, in the amount and direction of air flow. Therefore, the air drawing duct 27 can highly efficiently and evenly draw air across the entire range of an object (photosensitive drum 1 in the first embodiment), along which it is placed.

Further, the relationship between the interval D between the adjacent two partitioning walls 43 and the distance L from the intake opening 42 to the connective opening 45 is: D<L. Incidentally, the distance D is the distance from the intake opening 42 to the edge of the connective opening 45. Referring to FIG. 4, if the relationship between the interval D and distance L is changed to D>L, the force which generates an air flow in the air drawing duct 27 increases in its component which pulls the air in the air drawing duct 27 toward the outlet opening 44, making the partitioning walls 43 less effective in their function to rectifying (straightening) the air movement. With the partitioning walls 43 being less effective in their air flow rectifying function, the air flow between the intake 42 and connective opening 45, that is, the air flow in each first duct 40, is likely to deviate in angle. With the air flow in the first duct 40 being deviated in angle, the first ducts 40 are unequal in the amount of force by which the external air is drawn into the air drawing duct 27 through their intake openings 42. In this embodiment, therefore, the air drawing duct 27 is structured so that the relationship between the interval D and distance L is: D<L. Therefore, the partitioning walls 43 are more effective in their function of rectifying air movement. Therefore, the air flow between the intake 42 and connective opening 45 is less likely to deviate in angle. Therefore, the air drawing duct 27 in this embodiment is uniform across its entire lengthwise range in the amount of force by which air is suctioned into the duct 27.

Further, all the first ducts 40 share the floor wall 46, and the adjacent two first ducts 40 share the partitioning wall 43 which separates them. In other words, the air drawing duct 27 is structured as if the second duct 41 and corresponding first duct 40 were formed by folding a single duct. Therefore, the second and first ducts 41 and 40 can be placed in a tiny space, such as the one shown in FIG. 1. Further, each partitioning wall 43 is shared by the adjacent two ducts which are separated by the wall. Therefore, the air drawing duct 27 is significantly smaller in the amount of material necessary to produce it, greater (as large as possible) in the size of the cross section of the air passage, and less in weight than an air drawing duct 27 in accordance with the prior art.

Next, referring to FIG. 3(*b*), the second duct 41 is shaped so that its cross section is in the form of a long and narrow regular parallelepiped. In terms of the lengthwise direction of the air drawing duct 27, its dimension is the same as that of the first duct 40. In other words, it is shaped so that it is as large as possible in terms of the cross section of the air flow therein while being limited in its external size. On the downstream side of the outlet opening 44, the air drawing fan 50 and toner recovery filter 51 are disposed (FIG. 2(*a*)). As the air drawing fan 50 is started to extract air from within the main assembly of the image forming apparatus 30, the second duct 41 is reduced in internal pressure, causing the air to flow into the second duct 41. As the air enters the second duct 41 through each intake opening 42, it descents into the second duct 41 through the connective opening 45, and joins the air flow in the second duct 41. Then, it ascends at a gentle angle through the second duct 41, and is exhausted through the outlet opening 44.

The second duct 41 is provided with the outlet opening 44, the plane of which is perpendicular to the lateral wall of the air drawing duct 27, which is provided with the intake openings 42. In terms of the direction perpendicular to the lengthwise direction of the air drawing duct 27, the outlet opening 44 is on the same side of the air drawing duct 27 as the intake opening 42, that is, on the opposite side of the air drawing duct 27 from the connective opening 45. Therefore, the line of air flow, which connects a given connective opening 45 and the outlet opening 44 does not intersect or overlap with the line of air flow, which connect another connective opening 45 and the outlet opening 44. Therefore, the body of air having entered the second duct 41 through one of the connective openings 45, and the body of air having entered the second duct 41 through another connective opening 45 are virtually undisturbedly guided to the outlet opening 44; they are guided while remaining in the same state as the state in which they were after they are rectified, being therefore remaining roughly in parallel to each other. Further, of any two first ducts 40, the one closer to the outlet opening 44 is greater, in the angle of the line of air flow which connects this first duct 40 to the outlet opening 44, than the other first duct 40. Therefore, of any two connective openings 45, the difference between the one closer to the outlet opening 45 and the other, in the length of the virtual air passage in the second duct 42, through which a body of air has to travel to reach the outlet opening 44 after it enters the second duct 42 through the connective openings 45, is significantly smaller than it is in the case of an air drawing duct in accordance with the prior art. Therefore, the connective openings 45 of the air drawing duct 27 in the first embodiment are significantly less different in the amount of air pressure, being therefore more uniform in the amount by which air flows into the second duct 41 through them than those of an air drawing duct in accordance with the prior art. Therefore, the connective openings 45 of the air drawing duct 27 in the first embodiment are more uniform in the amount by which air flows through them than those of an air drawing duct 27 in accordance with the prior art.

The air drawing duct 27 is structured so that air is drawn through the first and second sections. The first section is made up of the multiple first subsections (first ducts 40) which are high in flow resistance. The second section (second duct 41), that is, the common duct, which is not partitioned, being therefore low in flow resistance. Therefore, even thought the air drawing duct 27 is in the form of a long and narrow regular parallelepiped, being therefore small in cross section, its intake openings 42, which are arranged across the entire lengthwise range of the duct 27, are uniform in the amount of force by which air is drawn into the duct 27 through the intake openings 42. Therefore, the air drawing duct 27 is uniform in the amount of air drawing force, across its entire lengthwise range, that is, the range from the outlet opening 44 to the farthest intake opening 42, and can draw air with the minimum amount of pressure loss.

Further, the pressure loss which is caused by the first ducts 40 closer to the outlet opening 44, is utilized to provide a sufficient amount of difference in air pressure between the connective opening 45 and intake opening 42 of each of the first ducts 40 farther from the outlet opening 44, in order to secure a necessary amount of air flow.

With the employment of the above described structural arrangement, it is possible to make all the first ducts 40 of the air drawing duct 27 between one lengthwise end of the air drawing duct 27 to the other, significantly less different in the amount of air flow. In other words, an air exhausting duct, such as the air drawing duct 27 in this embodiment, which is more desirable in the characteristic of the air flow therein, higher in efficiency, and smaller in size, can be realized by structuring the air drawing duct 27 as if its second section (second ducts 41) and first section (made up of first ducts 40), were created by folding a single air duct into the top and bottom sections.

In the case of the air drawing duct 27, air flow is uniform in each of its intake openings 42, and also, the intake openings 42 are small in the difference in the direction of air flow. An air drawing duct which is desirable in the characteristic of the air flow therein and high in efficiency can be made more compact by structuring it so that the top section (first section made up of first ducts 40) and bottom section (second duct 41) share a partitioning wall (flow wall 46 of first section), and also, so that the adjacent two first ducts 40 share a partitioning wall (partitioning wall 43). With the employment of this structural arrangement, an air drawing duct 27 can be reduced in cross section without sacrificing the second duct 41 in cross section.

FIG. 5(*a*) shows the direction and strength of the air flow in the air duct, which were obtained by the calculation based on the results of the simulation carried out with the use of an air drawing duct which is the same in measurements as the air drawing duct 27 to study the internal air flow of the air drawing duct 27. The arrows in the drawing are vectorial; they show the direction and velocity of the air flow in each first duct 40. Since the air drawing duct 27 is structured so that air flows from the intake opening 42 to the corresponding connective opening 45, not only is the air flow in each first duct 40 perpendicular to the lateral wall of the air drawing duct 27, which has the first ducts 42, but also, all the first ducts 40 are virtually uniform in internal air velocity. In order to equalize all the first ducts 40 in the velocity with which air is drawn through them, the balance among each intake opening 42, corresponding connective opening 45, and corresponding outlet opening 44 has to be optimized.

In this embodiment, all the intake opening 42 are made the same in dimension, being 28 mm in width and 3 mm in length. However, the connective openings 45 are made the same in the dimension in terms of the lengthwise direction of the air drawing duct 27, being 28 mm in width, but, different in the dimension in terms of the direction perpendicular to lengthwise direction of the air drawing duct 27, being 1 mm, 1 mm, 1 mm, 2.5 mm, 5 mm, 10 mm, 20 mm, and 20 mm, respectively, listing in the order of the closest one to the outlet opening 44. The outlet opening 44 is 18 mm×13 mm in size. The amount of air flow which the exhaust fan 50 needs to generates is 486,400 $mm^3$/sec.

The numerical values given above are the referential values set based on the assumption that the size of the outlet opening 44 is as described above. In other words, the amount of air flow which the air drawing fan 50 is required to generate can be reduced by enlarging the outlet opening 44.

Incidentally, in this embodiment, the air drawing duct 27 is roughly 280 mm in overall length. However, the overall length of the air drawing duct 27 is determined by the length of the photosensitive drum 1, in other words, the dimension of the recording medium P, which is needless to say. Further, each intake opening 42 may be reduced in width from 28 mm so that the air drawing duct 27 can be provided a larger number of intake openings 42 (which will be arranged in higher density) than the number of intake openings 42 in this embodiment. In such a case, the number of first ducts 40 will be greater than 9, which is obvious.

FIG. 5(*b*) shows the direction and strength of the air flow in the air duct, which were obtained by the calculation based on the results of the simulation carried out with the use of an air drawing duct 127, that is, the first comparative air drawing duct, which is the same in external appearance and the structure of the second duct 41 (second section) as the air drawing duct 27, but, is different in the first section (it does not have partitioning wall; there is no first duct 40). However, in order to balance the nine intake openings 142 in terms of the amount of air flow, the air drawing duct 127 is structured so that the greater the distance from the outlet opening 44, the greater in size the intake openings 142.

In this case, the farther from the outlet opening 44, the smaller the amount of air drawing force, as described above, and also, the difference in the amount of air drawing force is substantial. Therefore, even if the intake openings 142 farther from the outlet opening 44 are substantially increased in size compared to those closer to the outlet opening 44, those farther from the outlet opening 44 do not increase much in air flow. Moreover, the direction in which air is drawn into the air drawing duct 127 is not perpendicular to the wall of the air drawing duct 127, which has the intake openings 142; air is drawn into the air drawing duct 127 at a certain angle.

<Modified Version>

Figure 6:
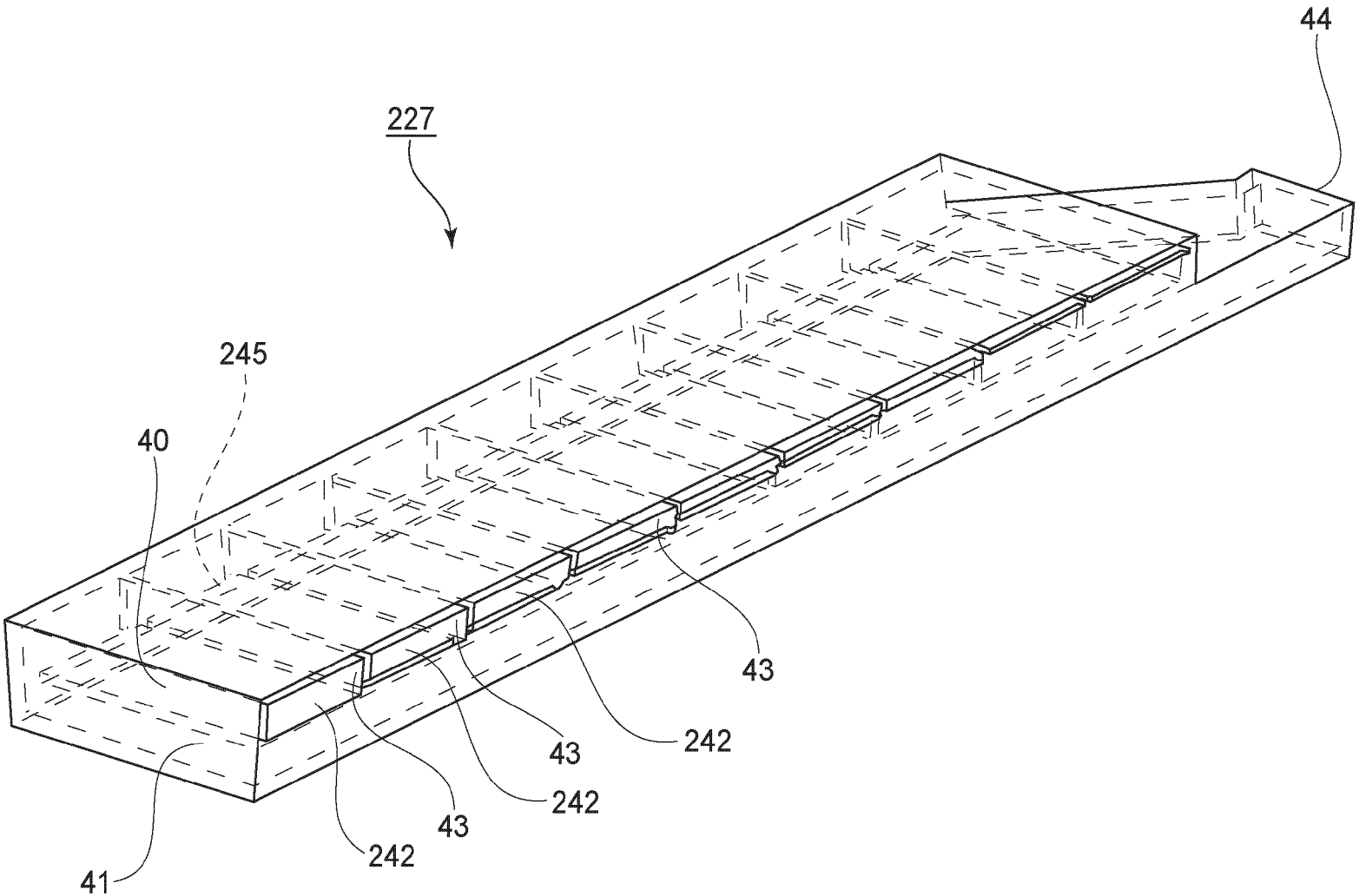
FIG. 6 is a schematic phantom perspective view of the modified version of the duct in the first embodiment.
Figure 7:
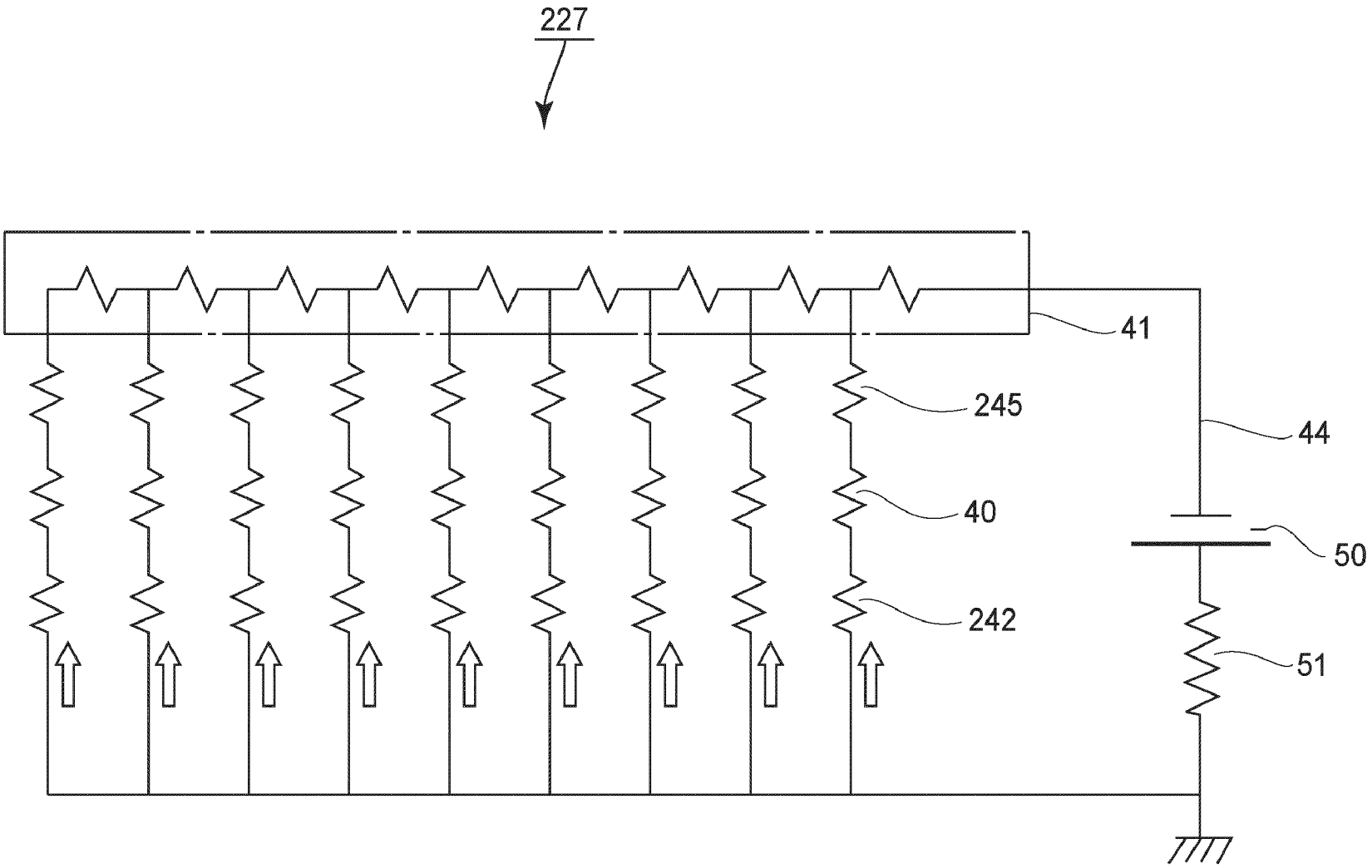
FIG. 7 is a schematic drawing which shows, in concept, the air flow resistance in the modified version of the air drawing duct in the first embodiment.

FIG. 6 is a schematic perspective view of the modified version of the air drawing duct in the first embodiment, and FIG. 7 is a schematic drawing which shows the concept of the air flow resistance of the air drawing duct. The air drawing duct 227, that is, the modified version of the air drawing duct 27 shown in FIG. 1, is mostly the same in structure as the air drawing duct 27; the air drawing duct 227 is different from the air drawing duct 27 only in that the intake openings 242 of the air drawing duct 227 are different from the intake openings 42 of the air drawing duct 27. Therefore, the structural components of the air drawing duct 227 shown in FIGS. 6 and 7, which are similar in structure to their counterparts of the air drawing duct 27, are given the same referential symbols as those given to the counterparts, and will not be described in detail. The intake opening 242 and connective opening 245 are different from the intake opening 42 and connective opening 45 of the air drawing duct 27 only in the dimension (in terms of direction in which they are aligned.

Referring to FIG. 6, the air drawing duct 227 is provided with multiple first ducts 40 and a single second duct 41. The connective opening 245 of each of the first ducts 40 of the air drawing duct 227 is the same in size as the connective opening 245 of the other first duct 40 of the air drawing duct 227. However, the intake opening 242 of each of the first ducts 40 of the air drawing duct 227 is different in size from the other first duct 40 of the air drawing duct 227.

In other words, the air drawing duct 227 is structured so that all of its connective openings 245 are equal in size, and also, so that the farther from the outlet opening 44, the greater in size the intake openings 242. This setup was devised to equalize all the intake openings 242 in air flow velocity (which is comparable to relationship between connective opening 45 in FIG. 3(*a*), and connective openings 42 in FIG. 2(*a*)).

Referring to FIG. 7, it may be reasonable to think that the air drawing duct 227 is structured so that the first ducts 40, which branch from the second duct 41 and are higher in flow resistance than the second duct 41, align side by side in parallel in the direction parallel to the axial line of the photosensitive drum. Strictly speaking, the outlet opening 44 is placed on the opposite side from the connective opening 45 in terms of the direction perpendicular to the axial line of the photosensitive drum 1, to prevent the lines of air flow which connect the multiple first ducts 40 to the outlet opening 44, from overlapping or intersecting. Therefore, in a strict sense, it cannot be said that the flow resistance of the second duct 41, and the flow resistances of the first ducts 40, which combine to make up the overall air flow resistance of the air drawing duct 27, are connected in series. However, for convenience, they may be thought to be connected in series.

In this case, the air drawing fan 50 and toner recovery filter 51 are connected in series. As a body of air flows into a given first duct 40 through the intake opening 242, it flows into the second duct 41 through the connective opening 245, and joins the air flow in the second duct 42.

Therefore, the air drawing duct 227 is desired to be structured so that the closer to the outlet opening 44, the greater in the air flow resistance the first ducts 40 (inclusive of those of corresponding connective opening and intake opening). This is for compensating the connective openings 245 for their loss in air pressure (negative pressure), the amount of which corresponds to their distance from the outlet opening 44.

As for a method for increasing the air flow resistance of the first duct 40 (inclusive of those of corresponding connective opening 245 and intake opening 242), in the case of the air drawing duct 27, shown in FIG. 2, it is structured so that the closer to the outlet opening 44, the smaller in size the connective opening 45 of the first duct 40. In the case of the air drawing duct 227, it is structured so that the closer to the outlet opening 44, the smaller the intake openings 242.

Incidentally, the effects similar to the above described effects can be achieved using methods other than the above described ones. For example, the first ducts 40 may be reduced in cross section, or an object capable of increasing the air flow resistance of the first duct 40 itself may be placed in the first duct 40. These methods may be individually employed or in combination.

In the above, the first embodiment and its modified version were described with reference to the cases in which the air drawing ducts 27 and 227 recover the toner particles having scattered from the developing apparatus 3 shown in FIG. 1. However, their application is not limited to a developing apparatus. For example, they may be placed in the adjacencies of the charging device 2 to recover ozone, or in the adjacencies of the cleaning apparatus 6 to recover the scattered recovered toner. Further, instead of being placed in the adjacencies of the peripheral surface of the photosensitive drum 1, they may be placed in the adjacencies of the fixing apparatus 23 to prevent the increase in humidity.

Further, not only are the air drawing ducts 27 and 227 effective to draw the internal air of an apparatus (image forming apparatus 30), but also, to blow external air into an apparatus, uniformly across the entire range of the apparatus, to air cool the interior of the apparatus. In this case, the intake openings 42 is to be read as "outlet openings 42", and the outlet opening 44 is to be read "intake opening 44". The air drawing duct 27, which is an example of air duct, is to be read as "air supply duct 27". The air drawing fan 50, which is an example of fan, is to be read as "air supply fan 50". The second duct 41, which is an example of air passage creates an air flow directed toward the first duct 40.

The intake opening 42, which is an example of opening through which air is drawn, is to be read as "voutlet opening 42". Thus, the first duct 40 sends the air supplied from the second duct 41 through the connective opening 45, which is an example of passage between the second duct 41 and first duct 40, to the "voutlet opening 42".

Comparative Example 2

Figure 8:
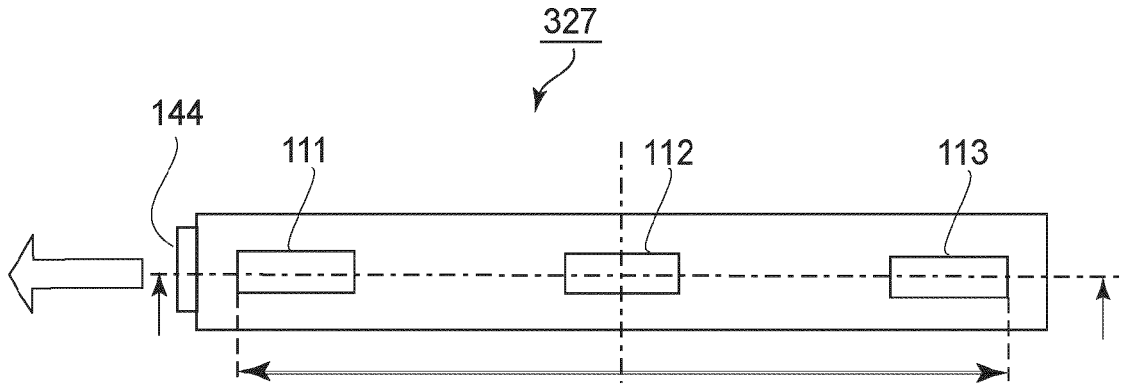
FIG. 8 is a schematic drawing which shows the second comparative air drawing duct.
Figure 8:
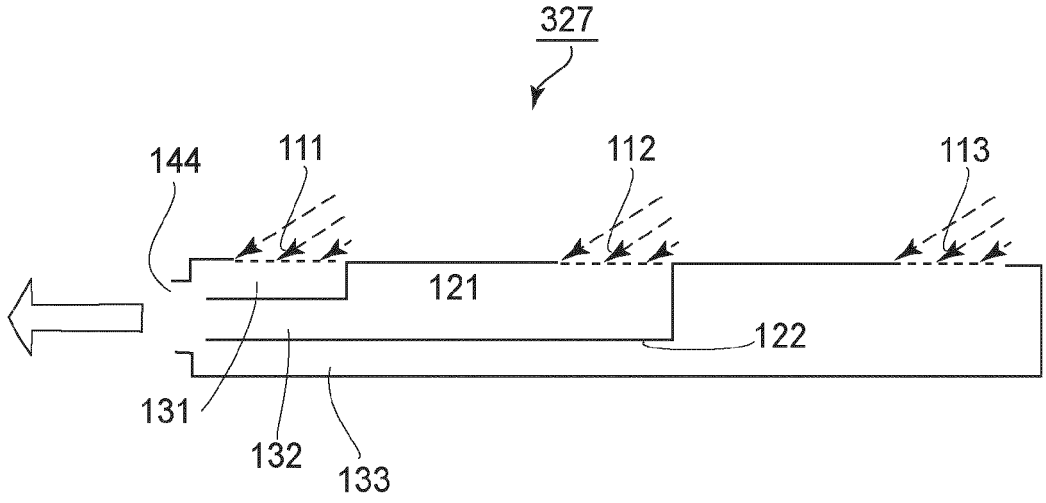

FIG. 8 is a schematic drawing of Comparative Example 2 of air drawing duct. FIG. 8(*a*) is a plan view of the air drawing duct, as seen from the intake opening side, and FIG. 8(*b*) is a side view of air drawing duct, the wall of which having the intake openings is facing upward.

As an image forming apparatus which uses toner is operated, toner articles sometimes leak from its developing apparatus, cleaning apparatus, etc. Thus, as the image forming apparatus is used for an extended length of time, toner particles scatter in the image forming apparatus. Further, a corona discharging device or the like generates ozone while it discharges corona to charge a photosensitive member. Thus, in the case of an image forming apparatus which uses toner and a corona discharging device (as charging apparatus), not only do toner sometimes scatter in the image forming apparatus, but also, ozone is released into the interior of the image forming apparatus. If toner scatters in an image forming apparatus and/or ozone is released within the image forming apparatus, the photosensitive drum, charging apparatus, etc., are contaminated by the toner and/or ozone, which may results in the nonuniform charging of the photosensitive drum. Further, there is a possibility that the scattered toner particles and/or ozone may adhere to the surface of the gears and shafts which are involved in the driving of the photosensitive drum and the like. The adhesion of the toner and/or ozone increases the amount of frictional load to which the driving mechanism is subjected, or may reduce the image forming apparatus in operational accuracy.

Therefore, it was proposed to provide an image forming apparatus with an air drawing duct 327, which is for drawing air to capture the scattered toner particles and/or ozone in the image forming apparatus with a filter, in order to remove them, and which is uniform in the amount of air drawing force, across roughly its entire range in terms of the lengthwise direction of the photosensitive drum (Patent Document 1).

Referring to FIG. 8(*a*), the air drawing duct 327 is in the form of a parallelepiped. Its top wall has three air intake openings 111, 112, and 113, which are aligned with equal intervals. There are unshown air drawing fan and a toner recovery filter, which are connected in series, and are located next to the outlet opening, that is, the opening with which one of the lengthwise ends of the air drawing duct 327 is provided.

Referring to FIG. 8(*b*), there are two partitioning walls 121 and 122 in the air drawing duct 327. The partitioning wall 121 separates an air flow passage 131 from an air flow passage 132. The air flow passage 131 is dedicated to the intake opening 111, and extends from the intake opening 111 to the outlet opening 144. The air flow passage 132 is dedicated to intake opening 112, and extends from the intake opening 112 to the outlet opening 144. The partitioning wall 122 separates the air flow passage 132 from an air flow passage 133, which is dedicated to the intake opening 113 and extends from the intake opening 113 to the outlet opening 144. Therefore, the air passages 131, 132, and 133 which are dedicated to the intakes 111, 112, and 113, respectively, and extend therefrom to the outlet opening 144 where the unshown air drawing fan is located, do not intersect.

Further, the air drawing duct 327 is structured so that the air flow passage 131 corresponding to the intake opening 111, that is, the intake opening closest to the outlet opening 144 is smaller in cross section than the air flow passage 132 corresponding to the intake opening 112, and also, so that the air flow passage 133 corresponding to the intake opening 113, that is, the intake opening farthest from the outlet opening 144 is larger in cross section than the air flow passage 132 corresponding to the intake opening 112. That is, the air flow passages 131, 132, and 133 are made different in cross section to roughly equalize them in the amount of air flow. Incidentally, the air flow passages 131, 132, and 133 may be adjusted in the amount of air flow by making the intake openings 111, 112, and 113 different in the size of cross section.

Also in the case of the air drawing duct 327, that is, second comparative example of air drawing duct, the farther from the outlet opening 144, the smaller the amount of air drawing force. That is, in terms of the air drawing force, the intake opening 111 is stronger than the intake opening 112, which is stronger than the intake opening 113. Structuring the air drawing duct 327 to provide the intake 113, that is, the farthest intake opening from the outlet opening 144, with a sufficient amount of air drawing force, makes the intake opening 111, that is, the closest intake opening to the outlet opening 144, excessively high in the amount of air drawing force, making it possible for a toner image formed on the photosensitive drum to be disturbed. Further, it makes the direction in which air is drawn into the air drawing duct 327 through the intake openings 111, 112, and 113, incline as shown in FIG. 8(*b*), in a manner to place the downstream end of the air flow closer to the outlet opening 144 than the upstream end, instead of making the air flow perpendicular to the photosensitive drum. This was the cause of the reduction in the efficiency with which the scattered toner particles and ozone are recovered. In order to prevent the occurrence of this phenomenon, the intervals among the intake openings 111, 112, and 113 must be substantially increased, making it necessary to increase in size the air drawing duct 327. Increasing in size the air drawing duct 327 makes it impossible for the duct 327 to be placed in a tiny space, such as the internal space of an image forming apparatus.

On the other hand, the air drawing duct 27 shown in FIG. 2, which is the air drawing duct in the first embodiment, is provided with a substantially larger number of intake openings 42 which are substantially smaller in the measurement in terms of the direction parallel to the axial line of the photosensitive drum than the air drawing duct 327. Further, the intake openings 42 are arrange side by side in parallel in a single straight line from one lengthwise end of the air drawing duct 27 to the other. Therefore, the second duct 41 of the air drawing duct 27 in the first embodiment is smaller in the difference in the amount of air drawing force, between the outlet opening 44 and the opposite end from the outlet opening 44. In other words, the amount of force with which air is drawing into the air drawing duct 27 across its range closer to the opposite lengthwise end of the air drawing duct 27 from the outlet opening 44 was increased by providing a large number of narrower (in terms of direction parallel to axial line of photosensitive drum) intake openings, which are arranged side by side in parallel in a straight line from lengthwise end of the air drawing duct 27 to the other. Not only can this structural arrangement minimize each intake opening 42 in terms of the nonuniformity in the amount of internal air flow, but also, it minimizes the difference, in the direction in which air is drawn into the air drawing duct 27, among the intake openings 42.

As described above, according to the present invention, an air duct can be made uniform in the amount by which air is drawn into the duct, across its entire range in terms of its lengthwise direction, without increasing the duct in size.

Incidentally, in the preceding embodiments of the present invention, the air drawing ducts were disposed next to the photosensitive drum. However, the preceding embodiments are not intended to limit the location of the placement of an air drawing duct in accordance with the present invention, to the adjacencies of a photosensitive drum. For example, an air drawing duct in accordance with the present invention may be placed next to an intermediary transferring member, that is, a member on which a toner image is borne. In other words, it may be placed in the adjacencies of any object, from which air needs to be evenly drawn away, across its entire lengthwise range.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 046088/2007 filed Feb. 26, 2007, which is hereby incorporated by reference.

What is claimed is:

1. A duct for an image forming apparatus for forming an image on a recording material, said duct comprising:

a discharge opening for discharging air;

a fan, mounted to a neighborhood of said discharge opening, for discharging the air;

first and second openings for suction of air;

a first guiding portion, having first and second openings, for guiding the sucked air;

a separation member, provided in said first guiding portion, for separating a flow of the air sucked by said first opening and a flow of the air sucked by said second opening;

a second guiding member, disposed overlapped with said first guiding portion, for guiding the air guided by said first guiding portion;

a first interconnection opening for feeding the air from said first opening to said second guiding portion;

a second interconnection opening for feeding the air from said second opening to said second guiding portion, wherein said first interconnection opening is disposed closer to said discharge opening than said second interconnection opening, and wherein said first interconnection opening has a size smaller than said second interconnection opening.

2. A duct according to claim 1, wherein said first opening has an opening area which is the same as that of said second opening.

3. A duct according to claim 1, wherein a gap between said first opening and said first interconnection opening is larger than a gap between said second opening and said second interconnection opening.

4. A duct according to claim 1, wherein said first opening is overlapped with said second opening with respect to a direction perpendicular to a direction with respect to which said first guiding portion and said second guiding portion are overlapped with each other.

5. A duct according to claim 4, wherein said discharge opening is disposed at a side surface of said second guiding portion with respect to a direction in which said first opening and said second opening are arranged.

6. An image forming apparatus comprising **:

a rotatable image bearing member for carrying a toner image;

a duct, disposed opposed to said image bearing member, for sucking air from a neighborhood of said image bearing member, said duct comprising:

a discharge opening for discharging air;

a fan, mounted to a neighborhood of said discharge opening, for discharging the air;

first and second openings, disposed opposed to said image bearing member, for suction of air;

a first guiding portion, having first and second openings, for guiding the sucked air;

a separation member, provided in said first guiding portion, for separating a flow of the air sucked by said first opening and a flow of the air sucked by said second opening;

a second guiding member, disposed overlapped with said first guiding portion, for guiding the air guided by said first guiding portion;

a first interconnection opening for feeding the air from said first opening to said second guiding portion;

a second interconnection opening for feeding the air from said second opening to said second guiding portion, wherein said first interconnection opening is disposed closer to said discharge opening than said second interconnection opening, and wherein said first interconnection opening has a size smaller than said second interconnection opening.

7. An apparatus according to claim 6, wherein said first opening has an opening area which is the same as that of said second opening.

8. An apparatus according to claim 6, wherein a gap between said first opening and said first interconnection opening is larger than a gap between said second opening and said second interconnection opening.

9. An apparatus according to claim 6, wherein said first opening is overlapped with said second opening with respect to a direction perpendicular to a direction with respect to which said first guiding portion and said second guiding portion are overlapped with each other.

10. An apparatus according to claim 9, wherein said discharge opening is disposed at a side surface of said second guiding portion with respect to a direction in which said first opening and said second opening are arranged.

* * * * *